United States Patent [19]

Farrall

[11] Patent Number: 5,039,903

[45] Date of Patent: Aug. 13, 1991

[54] EXCITATION COIL FOR AN ELECTRODELESS HIGH INTENSITY DISCHARGE LAMP

[75] Inventor: George A. Farrall, Rexford, N.Y.

[73] Assignee: General Electric Company, Schenectady, N.Y.

[21] Appl. No.: 493,266

[22] Filed: Mar. 14, 1990

[51] Int. Cl.[5] ..... H01J 1/50; H05B 41/16

[52] U.S. Cl. ..... 313/160; 313/46; 315/248; 315/344; 315/112; 336/223

[58] Field of Search ..... 313/160, 161, 493, 46; 315/248, 344, 267, 236, 112, 283; 336/223, 61

[56] References Cited

U.S. PATENT DOCUMENTS

| | | | |
|---|---|---|---|
| 2,939,049 | 5/1960 | Blackman | 313/161 X |
| 3,987,334 | 10/1976 | Anderson | 315/248 X |
| 4,298,828 | 11/1981 | Justice et al. | 336/212 X |
| 4,810,938 | 3/1989 | Johnson et al. | 315/248 |
| 4,812,702 | 3/1989 | Anderson | 313/153 |
| 4,910,439 | 3/1990 | El-Hamamsy et al. | 313/638 X |

*Primary Examiner*—Donald J. Yusko
*Assistant Examiner*—Patel: Ashok
*Attorney, Agent, or Firm*—Jill M. Breedlove; James C. Davis, Jr.; Marvin Snyder

[57] ABSTRACT

An excitation coil for a high intensity discharge lamp has an optimized configuration for maximizing efficiency and minimizing output light blockage. The coil includes a conductive surface having a shape which corresponds to rotating a bilaterally symmetrical trapezoid about a coil center line in the same plane as the trapezoid without intersecting the center line. The conductive surface is disposed on a conductive core for efficient heat removal from the coil, resulting in reduced coil losses. In one embodiment, the coil cross section is increased by adding a rectangular portion to the trapezoidal portion, thereby extending the coil outwardly from the coil center line so as to remove heat from the coil more quickly without affecting light output from the lamp.

18 Claims, 6 Drawing Sheets

EXCITATION COIL FOR AN ELECTRODELESS HIGH INTENSITY DISCHARGE LAMP

FIELD OF THE INVENTION

The present invention relates generally to electrodeless high intensity discharge (HID) lamps. More particularly, the present invention relates to a high efficiency excitation coil for an HID lamp having an optimized configuration which results in minimal blockage of light output from the lamp.

BACKGROUND OF THE INVENTION

In a high intensity discharge (HID) lamp, a medium to high pressure ionizable gas, such as mercury or sodium vapor, emits visible radiation upon excitation typically caused by passage of radio frequency (RF) current through the gas. One class of HID lamps comprises electrodeless lamps which generate an arc discharge by generating a solenoidal electric field in a high-pressure gaseous lamp fill. In particular, the lamp fill, or discharge plasma, is excited by RF current in an excitation coil surrounding an arc tube. The arc tube and excitation coil assembly acts essentially as a transformer which couples RF energy to the plasma. That is, the excitation coil acts as a primary coil, and the plasma functions as a single-turn secondary. RF current in the excitation coil produces a varying magnetic field, in turn creating an electric field in the plasma which closes completely upon itself, i.e., a solenoidal electric field. Current flows as a result of this electric field, resulting in a toroidal arc discharge in the arc tube.

For efficient lamp operation, the excitation coil must not only have satisfactory coupling to the discharge plasma, but must also have low resistance and small size. A practical coil configuration avoids as much light blockage by the coil as possible and hence maximizes light output. One such coil configuration is described in commonly assigned U.S. Pat. No. 4,812,702 of J.M. Anderson, issued Mar. 14, 1989, which patent is hereby incorporated by reference. The excitation coil of the Anderson patent has at least one turn of a conductor arranged generally upon the surface of a torus having a substantially rhomboid or V-shaped cross section on either side of a coil center line. Another exemplary coil configuration is described in commonly assigned, U.S. Pat. No. 4,894,591, of H.L. Witting, issued Jan. 16, 1990 which is hereby incorporated by reference. The Witting application describes an inverted excitation coil comprising first and second solenoidally-wound coil portions, each being disposed upon the surface of an imaginary cone having its vertex situated within the arc tube or within the volume of the other coil portion.

During operation of an HID lamp, as the temperature of the excitation coil increases, coil resistance increases, thereby resulting in higher coil losses. Hence, to increase coil efficiency, the excitation coil of an HID lamp is typically coupled to a heat sink for removing excess heat from the excitation coil during lamp operation. Such a heat sink may comprise, for example, heat radiating fins coupled to the ballast used to provide radio frequency (RF) power to the lamp, as described in commonly assigned U.S. Pat. No. 4,910,439 of S.A. El-Hamamsy and J.M. Anderson, issued Mar. 20, 1990 which patent is hereby incorporated by reference.

Although the hereinabove described HID lamp excitation coil configurations are suitable for many lighting applications, it is desirable to provide an excitation coil exhibiting even higher efficiency, e.g. in excess of 90%, while providing efficient heat dissipation from the coil and causing minimal light blockage from the lamp.

OBJECTS OF THE INVENTION

Accordingly, it is an object of the present invention to provide a high efficiency excitation coil for an electrodeless HID lamp having an optimized configuration which avoids as much light blockage from the lamp as practicable.

Another object of the present invention is to provide a high efficiency excitation coil for an electrodeless HID lamp having effectual means for removing heat from the coil without reducing light output from the lamp.

SUMMARY OF THE INVENTION

The foregoing and other objects of the present invention are achieved in a new and improved excitation coil for an electrodeless HID lamp exhibiting very high efficiency and causing only minimal light blockage from the lamp. To these ends, the coil configuration is optimized in terms of the coupling coefficient between the coil and the arc discharge, and the quality factor Q of the coil. The overall shape of the excitation coil of the present invention is generally that of a surface formed by rotating a bilaterally symmetrical trapezoid about a center line situated in the same plane as the trapezoid, but which line does not intersect the trapezoid. The two parallel sides of the trapezoid are unequal in length, with the smaller side being situated toward the center of the coil surface. Preferably, the corners of the trapezoid are curved. According to the present invention, although the number of coil turns may be varied, depending upon the particular application thereof, the overall shape remains the same. In an alternative embodiment, the generally trapezoidal cross section is modified by adding a portion of rectangular cross section at the outer portion of the coil so that the longer of the two parallel sides of the trapezoid coincides with one of the sides of the rectangle, resulting in a larger cross sectional area and thus more efficient heat dissipation from the excitation coil, but without causing additional light blockage.

BRIEF DESCRIPTION OF THE DRAWINGS

The features and advantages of the present invention will become apparent from the following detailed description of the invention when read with the accompanying drawings in which.

DETAILED DESCRIPTION OF THE INVENTION

Figure 1A:
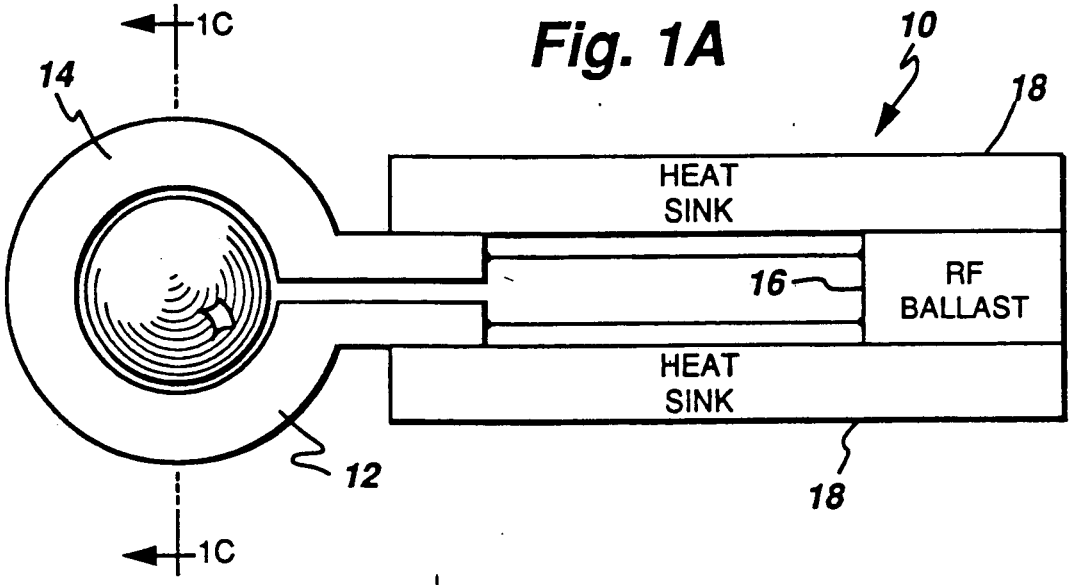
FIG. 1A is a partly schematic view of an HID lamp system, including a top view of an electrodeless HID lamp employing a high efficiency single-turn excitation coil in accordance with a preferred embodiment of the present invention.
Figure 1B:
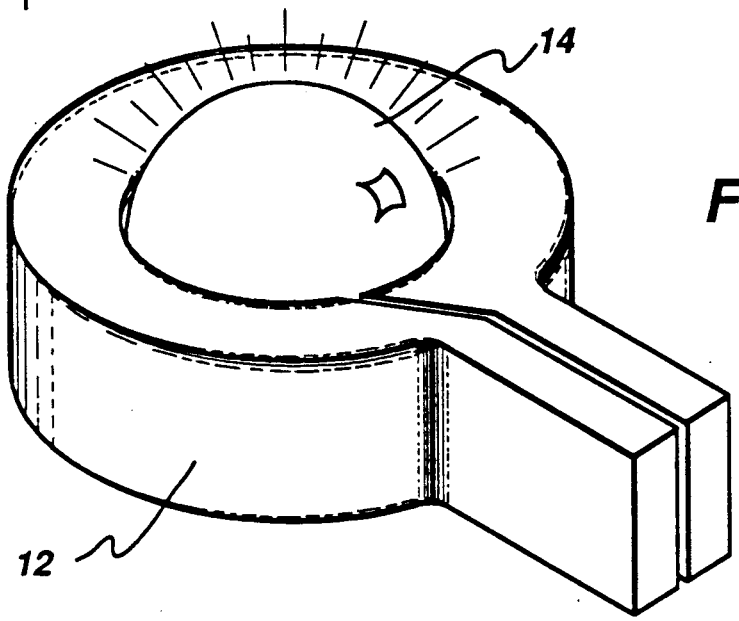
FIG. 1B is an isometric view of the single-turn excitation coil and arc tube of FIG. 1A.
Figure 1C:
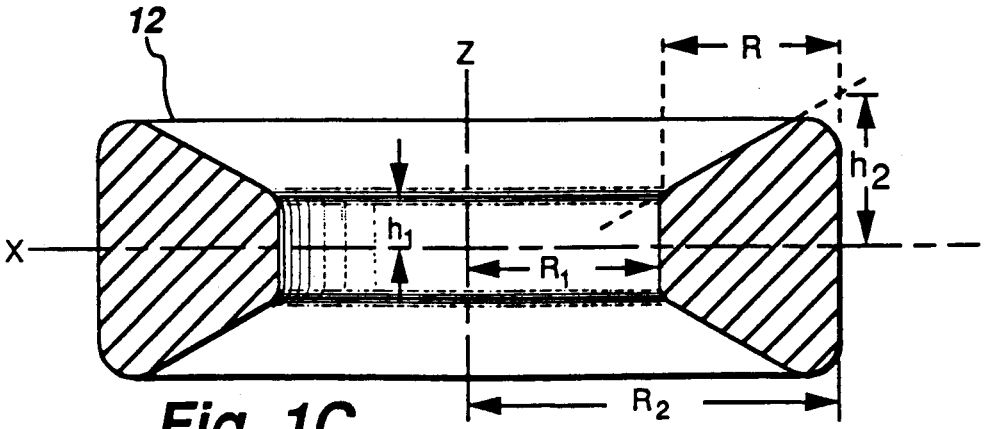
FIG. 1C is a cross sectional view of the single-turn excitation coil of FIG. 1A taken along line 1C—1C thereof.

FIGS. 1A through 1C illustrate an electrodeless HID lamp system 10 employing a single-turn excitation coil 12 surrounding an arc tube 14 in accordance with a preferred embodiment of the present invention. The arc tube is preferably formed of a high temperature glass, such as fused quartz, or an optically transparent ceramic, such as polycrystalline alumina. By way of example and clarity of illustration, arc tube 14 is shown as having a spherical shape. However, arc tubes of other shapes may be desirable, depending upon the application. For example, arc tube 14 may have the shape of a short cylinder, or "pillbox", having rounded edges, if desired, as described in commonly assigned U.S. Pat. No. 4,810,938, issued to P.D. Johnson, J.T. Dakin and J.M. Anderson on Mar. 7, 1989, which patent is hereby incorporated by reference. As explained in the Johnson et al. patent, such a structure promotes more nearly isothermal operation, thus decreasing thermal losses and hence increasing efficiency.

Arc tube 14 contains a fill in which a solenoidal arc discharge is excited during lamp operation. A suitable fill, described in U.S. Pat. No. 4,810,938, cited hereinabove, comprises a sodium halide, a cerium halide and xenon combined in weight proportions to generate visible radiation exhibiting high efficacy and good color rendering capability at white color temperatures. For example, such a fill according to the Johnson and Anderson patent may comprise sodium iodide and cerium chloride, in equal weight proportions, in combination with xenon at a partial pressure of about 500 torr. Another suitable fill is described in U.S. Pat. No. 4,972,120 of H.L. Witting, issued Nov. 20, 1990, and assigned to the instant assignee, which patent is hereby incorporated by reference. The fill of the Witting application comprises a combination of a lanthanum halide, a sodium halide, a cerium halide and xenon or krypton as a buffer gas. For example, a fill according to the Witting application may comprise a combination of lanthanum iodide, sodium iodide, cerium iodide, and 250 torr partial pressure of xenon.

As illustrated in FIG. 1A, radio frequency (RF) power is applied to the HID lamp by an RF ballast 16 via excitation coil 12 coupled thereto. Heat sink means 18 are shown thermally coupled to coil 12 and ballast 16 for removing heat from excitation coil 12. In operation, RF current in coil 12 results in a varying magnetic field which produces within arc tube 14 an electric field which completely closes upon itself. Current flows through the fill within arc tube 14 as a result of this solenoidal electric field, producing a toroidal arc discharge therein. Suitable operating frequencies for RF ballast 16 are in the range from 1 to 30 megahertz (MHz), an exemplary operating frequency being 13.56 MHz.

A suitable ballast 16 is described in commonly assigned, copending U.S. patent application of J.C. Borowiec and S.A. El-Hamamsy, Ser. No. 472,144, filed Jan. 30, 1990, which patent application is hereby incorporated by reference. The lamp ballast of the cited patent application is a high-efficiency ballast comprising a Class-D power amplifier and a tuned network. The tuned network includes an integrated tuning capacitor network and heat sink. In particular, a series/blocking capacitor and a parallel tuning capacitor are integrated by sharing a common capacitor plate. Furthermore, the metal plates of the parallel tuning capacitor comprise heat sink plates of a heat sink used to remove excess heat from the excitation coil of the lamp. Alternatively, as described in the El-Hamamsy and Anderson patent application cited hereinabove, a suitable electrodeless HID lamp ballast includes a network of capacitors that is used both for impedance matching and heat sinking. In particular, a pair of parallel-connected capacitors has large plates that are used to dissipate heat generated by the excitation coil and arc tube.

In accordance with the present invention, the configuration of excitation coil 12 is optimized to maximize coil efficiency $E_{coil}$ and minimize light blockage by the coil. To these ends, the coil configuration is optimized in terms of the coil quality factor Q and the coupling coefficient k between coil 12 and the arc discharge according to the following expression:

$$E_{coil} = \frac{k^2 Q\alpha}{k^2 Q\alpha + 1},$$

where $\alpha$ is a constant, the value of which depends on the size of arc tube 14. From the above expression, it is clear that coil efficiency $E_{coil}$ is maximized by maximizing the product $k^2Q$. The optimum coil configuration is thus obtained through an iterative process.

A single-turn excitation coil having an optimized configuration in accordance with a preferred embodiment of the present invention is shown in top view in FIG. 1A, in isometric view in FIG. 1B and in cross section in FIG. 1C. The overall shape of the excitation coil is generally that of a surface formed by rotating a bilaterally symmetrical trapezoid about a center line situated in the same plane as the trapezoid, but which line does not intersect the trapezoid. The two parallel sides of the trapezoid are unequal in length, with the smaller side being situated toward the center line. Preferably, the corners of the trapezoid are curved. In FIG. 1C, the coil center line is designated as the z-axis, and the x-axis is illustrated as being perpendicular thereto and bisecting the single-turn coil. The inner radius of the excitation coil extends from the center line along the x-axis to the smaller side of the trapezoid and is designated as $R_1$; and the outer radius extends from the center line along the x-axis to the outer edge of the coil and is designated as $R_2$. Along the z-axis, or center line, the distance from the x-axis to the inner edge of the coil is designated as $h_1$, while the distance from the x-axis to the outer edge of the coil is designated as $h_2$.

Figure 2:
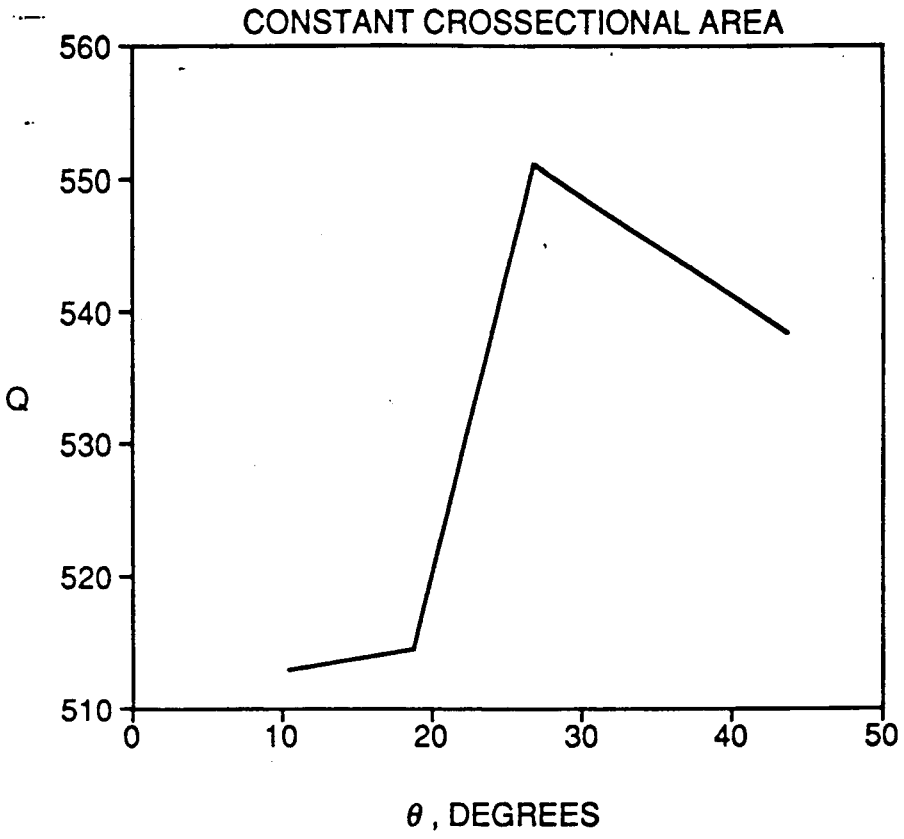
FIG. 2 is a graph of excitation coil quality factor Q versus contour angle $\theta$ for a constant cross sectional area useful in understanding the present invention.
Figure 3A:
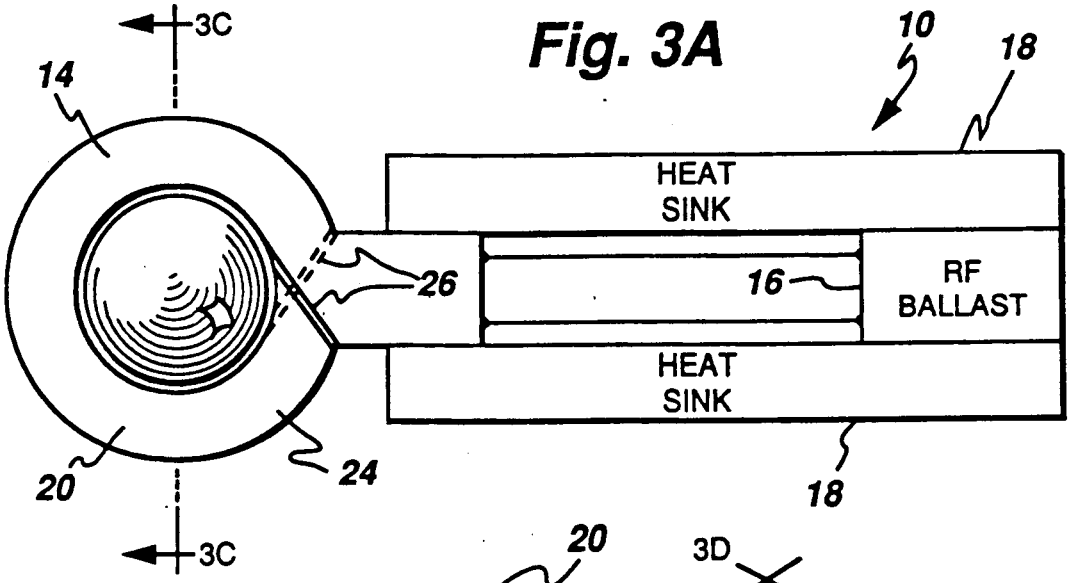
FIG. 3A is a partly schematic view of an HID lamp system, including a top view of an HID lamp employing a high efficiency two-turn excitation coil in accordance with a preferred embodiment of the present invention.
Figure 3B:
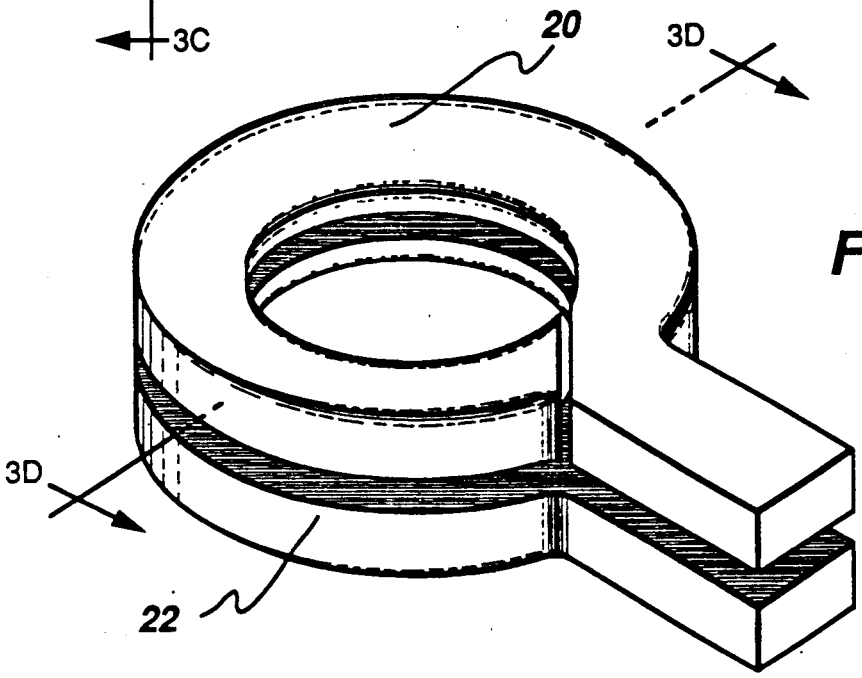
FIG. 3B is an isometric view of the two-turn excitation coil of FIG. 3A.
Figure 3C:
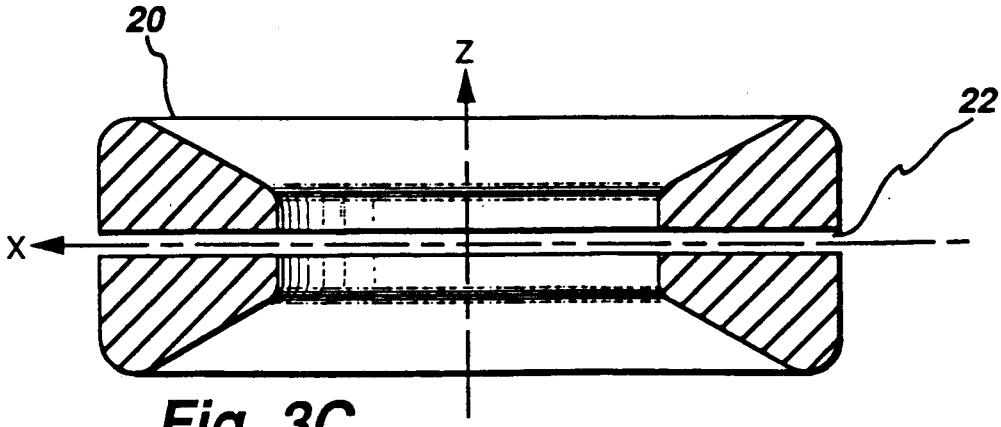
FIG. 3C is a cross sectional view of the two-turn excitation coil of FIG. 3A taken along line 3C—3C thereof.
Figure 3D:
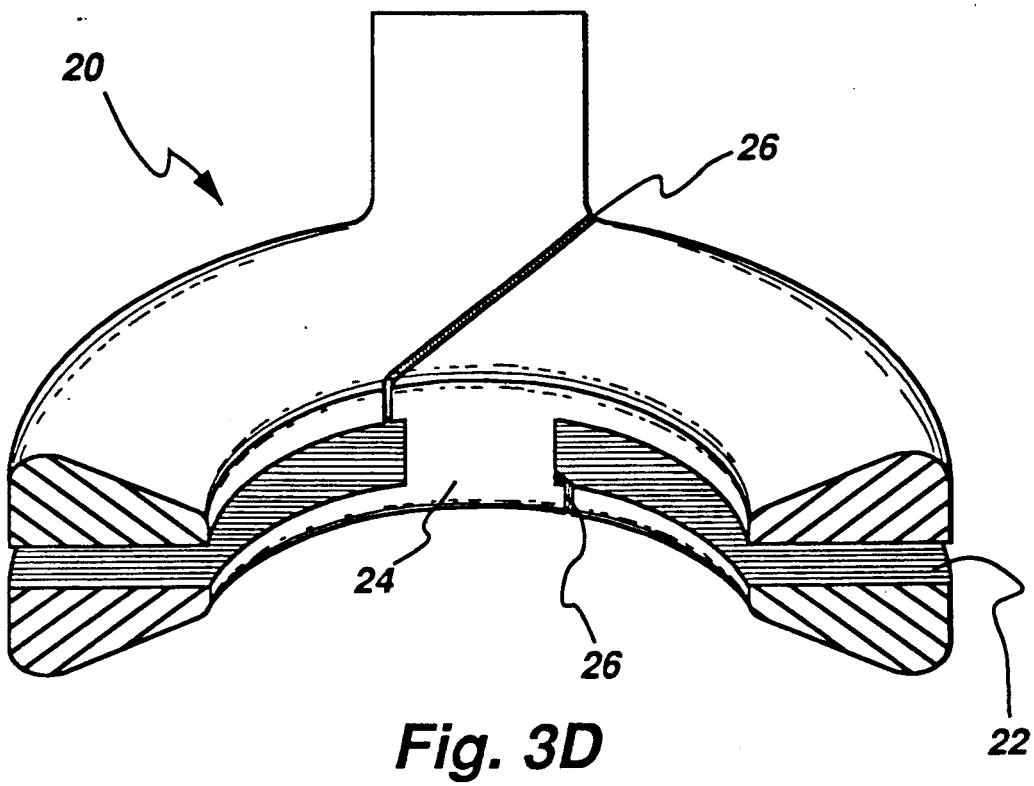
FIG. 3D is a transectional isometric view of the two-turn excitation coil of FIG. 3B taken along line 3D—3D.

FIG. 2 is a graph of quality factor Q of the excitation coil versus contour angle $\theta$ for a constant cross sectional area A, the contour angle $\theta$ being defined herein as the angle determined by the slope of each of the nonparallel sides of the trapezoid. As shown in FIG. 2, the quality factor Q is a maximum for $\theta \approx 28°$ for the chosen constant cross sectional area A. Hence, for contour angle $\theta \approx 28°$, the cross section of the optimized coil configuration is defined in terms of the following ratios:

$$\frac{R}{h_2} = 1.2,$$

and $$\frac{R}{h_1} = 3.2,$$

where R represents the height of the trapezeoid and is defined by the expression $R = R_2 - R_1$. For maximum coil efficiency with an excitation coil having a cross sectional area A, the aforesaid ratios are maintained constant, while the inner and outer radii of the excitation coil may be varied, depending on the size of the arc tube.

The principles of the present invention are applicable to excitation coils having any number of turns. For example, a two-turn excitation coil 20 in accordance with a preferred embodiment of the present invention is illustrated in FIGS. 3A through 3D. The cross sectional area and contour angle $\theta$ are substantially the same as those for the single-turn coil described hereinabove. The two turns of the coil are separated by a gap 22, e.g. up to approximately 4 millimeters wide for an arc tube having an arc diameter of approximately 12 millimeters, i.e. corresponding to $\alpha = 0.3$. In a preferred embodiment, the two-turn excitation coil is formed by separately casting two coil turns and connecting them together by brazing a triangular piece of conductor 24 (shown in FIGS. 3A and 3D) therebetween. Lastly, a slit 26 is made in each of the turn castings in order to connect the turns electrically in series.

Figure 4:
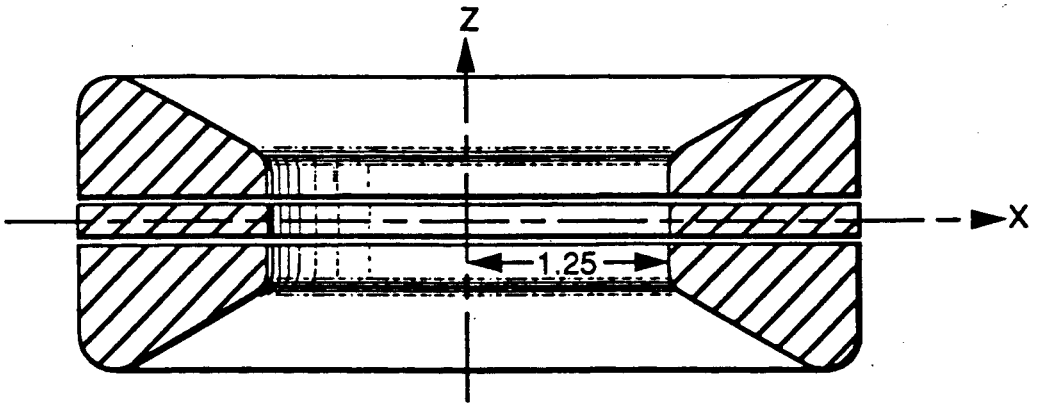
FIG. 4 is a cross sectional view of a three-turn excitation coil in accordance with a preferred embodiment of the present invention.
Figure 5:
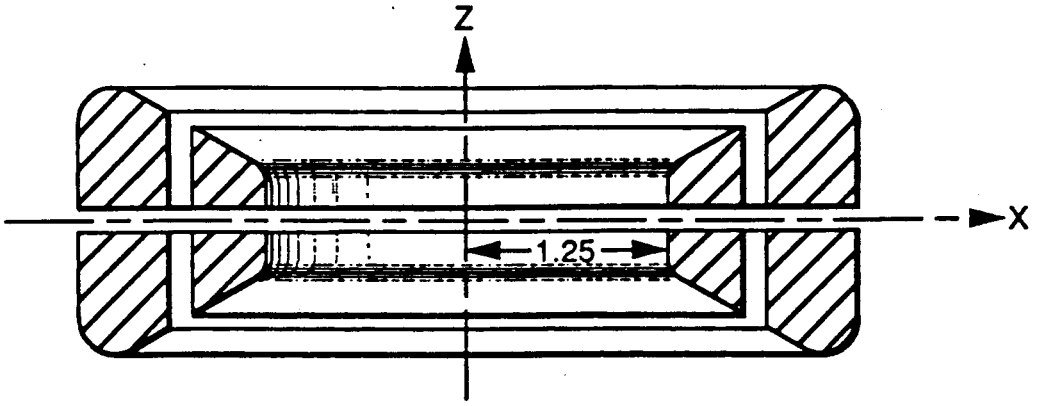
FIG. 5 is a cross sectional view of a four-turn excitation coil in accordance with a preferred embodiment of the present invention.

FIGS. 4 and 5 are cross sectional views of excitation coils having three and four turns, respectively, in accordance with the principles of the present invention. In particular, the cross sectional area and contour angle $\theta$ are substantially the same for the three-turn and four-turn coils as those for the single-turn coil of FIG. 1 and the two-turn coil of FIG. 3. The coil turns are connected in series in a manner similar to that described hereinabove with reference to the two-turn coil of FIG. 3.

In FIGS. 1 and 3–5, the excitation coils are each illustrated as being comprised of solid metal. However, since HID lamp excitation coils typically operate at high frequencies, as explained hereinabove, coil currents are carried substantially within a skin depth of the coil surface. At 13.56 MHZ, for example, the skin depth of copper is only about one mil. Therefore, if the coil core is not required to remove heat from the coil, i.e. another method of heat dissipation is being employed, then the excitation coil can be made as a hollow structure such as by casting, metal spinning, or electro-disposition of a conductive material onto a mold. For a coil so constructed, heat dissipation may be provided, for example, by circulating water according to a method well-known in the art.

Figure 6A:
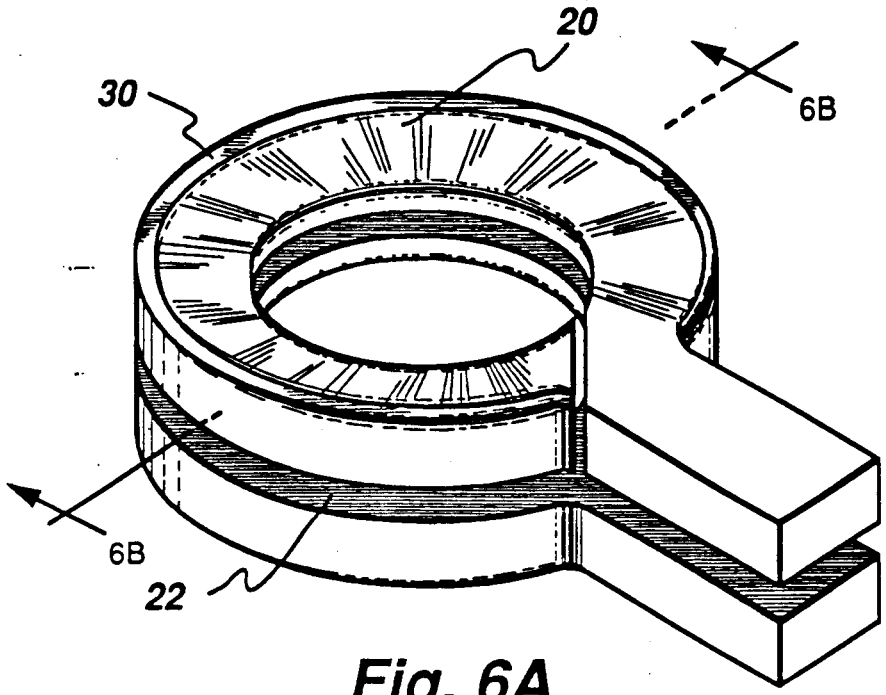
FIG. 6A is an isometric view of an alternative embodiment of the two-turn excitation coil of FIGS. 3A-3D.
Figure 6B:
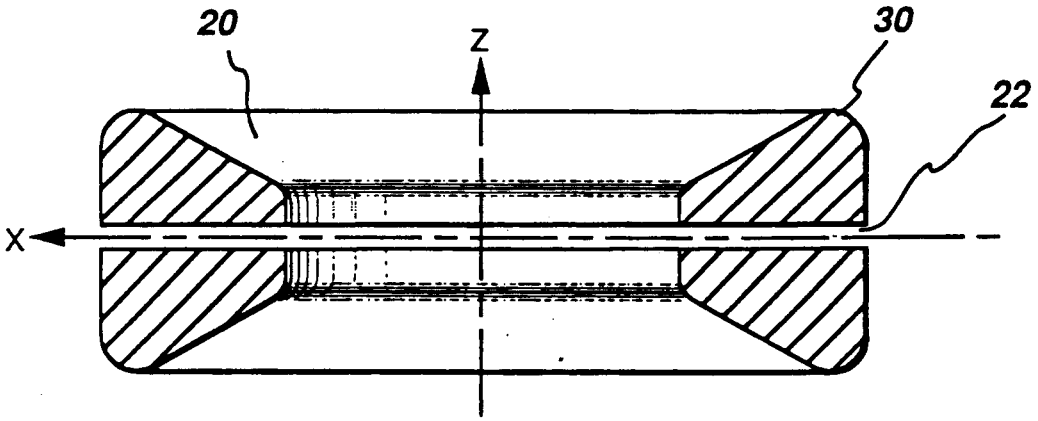
FIG. 6B is a cross sectional view of the two-turn excitation coil of FIG. 6A taken along line 6B—6B thereof.

An alternative embodiment of an excitation coil having a conductive surface disposed over a conductive core in accordance with a preferred embodiment of the present invention is shown in FIGS. 6A and 6B. By way of illustration, the alternative embodiment of FIGS. 6A and 6B is shown for a two-turn excitation coil. The coil cross section has been increased with respect to that of FIGS. 3A through 3B by, in effect, adding a rectangular portion 30 to the substantially trapezoidal cross section at the outer portion of the coil. As a result, heat is removed from the coil more quickly, without blocking additional light output from the lamp.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

What is claimed is:

1. An excitation coil for exciting an arc discharge in an electrodeless high intensity discharge lamp, comprising:

a conductive surface configured to form at least one coil turn, said conductive surface having a shape determined by rotating a substantially bilaterally symmetrical trapezoid about a center line which does not intersect said trapezoid, said trapezoid having a relatively short parallel side and a relatively long parallel side, said short parallel side being disposed toward said center line to form the inner surface of said coil; and means for coupling said excitation coil to a radio frequency power supply.

2. The excitation coil of claim 1 wherein said trapezoid has rounded edges.

3. The excitation coil of claim 1 wherein said trapezoid has a height R, said short parallel side has a length 2h1- and said long parallel side has a length 2h2 the cross section of said excitation coil being determined such that:

$$\frac{R}{h_2} = 1.2,$$

and $$\frac{R}{h_1} = 3.2.$$

4. The excitation coil of claim 1 wherein said conductive surface is configured to form at least two turns electrically connected in series.

5. The excitation coil of claim 1, further comprising heat conducting means contained substantially within said conductive surface for removing heat from said excitation coil.

6. The excitation coil of claim 5 wherein said heat conducting means comprises a heat conductive core on which said conductive surface is disposed.

7. The excitation coil of claim 5 wherein:

said conductive surface further comprises a rectangular portion disposed on said long parallel side of said trapezoid so that said long parallel side coincides with one side of said rectangular portion, the shape of said coil further being determined by rotating said rectangular portion about said center line; and said heat conducting means comprises a heat conductive core on which said conductive surface is disposed.

8. The excitation coil of claim 7, further comprising rounded edges.

9. The excitation coil of claim 7 wherein said conductive surface is configured to form at least two turns electrically connected in series.

10. An electrodeless high intensity discharge lamp, comprising:

a light-transmissive arc tube for containing a fill;

an excitation coil disposed about said arc tube for exciting an arc discharge in said fill, said excitation coil comprising a conductive surface configured to form at least one coil turn, said conductive surface having a shape determined by rotating a substantially bilaterally symmetrical trapezoid about a center line which does not intersect said trapezoid, said trapezoid having a relatively short parallel side and a relatively long parallel side, said short parallel side being disposed toward said center line to form the inner surface of said coil; and means for coupling said excitation coil to a radio frequency power supply.

11. The lamp of claim 10 wherein said trapezoid has rounded edges.

12. The lamp of claim 10 wherein said trapezoid has a height R, said short parallel side has a length 2-h 1 and said long parallel side has a length 2h2 the cross section of said excitation coil being determined such that:

$$\frac{R}{h_2} = 1.2,$$

and $$\frac{R}{h_1} = 3.2.$$

13. The lamp of claim 10 wherein said conductive surface is configured to form at least two turns electrically connected in series.

14. The lamp of claim 10, further comprising heat conducting means contained substantially within said conductive surface for removing heat from said excitation coil.

15. The lamp of claim 14 wherein said heat conducting means comprises a heat conductive core on which said conductive surface is disposed.

16. The lamp of claim 14 wherein:

said conductive surface further comprises a rectangular portion disposed on said long parallel side of said trapezoid so that said long parallel side coincides with one side of said rectangular portion, the shape of said coil further being determined by rotating said rectangular portion about said center line; and said heat conducting means comprises a heat conductive core on which said conductive surface is disposed.

17. The lamp of claim 16 wherein said excitation coil further comprises rounded edges.

18. The lamp of claim 16 wherein said conductive surface is configured to form at least two turns electrically connected in series.

* * * * *